US005989051A

United States Patent [19]

Zelno et al.

[11] Patent Number: 5,989,051

[45] Date of Patent: Nov. 23, 1999

[54] CONNECTOR FOR JOINING A CABLE TO A PCMCIA CARD

[75] Inventors: John Michael Zelno, Vista; Marc Henry Agnew; John Andre Guerre, both of Carlsbad, all of Calif.

[73] Assignee: ViaSat, Inc., Carlsbad, Calif.

[21] Appl. No.: 08/985,839

[22] Filed: Dec. 5, 1997

[51] Int. Cl.[6] ..... H01R 13/627

[52] U.S. Cl. ..... 439/362

[58] Field of Search ..... 439/362, 364, 439/365, 377.2, 378, 677, 953, 680

[56] References Cited

U.S. PATENT DOCUMENTS

| | | | |
|---|---|---|---|
| D. 379,087 | 5/1997 | Steinbugler . | |
| 5,420,733 | 5/1995 | Knighton et al. . | |
| 5,469,332 | 11/1995 | Alvité | 361/737 |
| 5,486,117 | 1/1996 | Chang | 439/357 |
| 5,521,369 | 5/1996 | Kumar . | |
| 5,540,601 | 7/1996 | Botchek | 439/502 |
| 5,608,607 | 3/1997 | Dittmer | 361/686 |
| 5,647,758 | 7/1997 | Ichikawa et al. | 439/362 |

*Primary Examiner*—Lincoln Donovan
*Assistant Examiner*—Eugene G. Byrd
*Attorney, Agent, or Firm*—Townsend & Townsend & Crew, LLP; Kenneth R. Allen

[57] ABSTRACT

A cable retention system is provided to connect a PC card, for example a PCMCIA card, to a cable. The cable portion includes an electrical connector on a cable that is overmolded with a backshell. The backshell incorporates captivated thumbscrews that can be at least partially withdrawn into the backshell. The thumbscrews may engage threads in the PC card to provide a secure attachment, or the thumbscrews may be withdrawn into the backshell, so that the electrical connector on the cable may be pushed onto the mating electrical connector on the PC card. In another embodiment, an electronic device, such as a wireless or ROM module, is attached to the PC card.

32 Claims, 5 Drawing Sheets

CONNECTOR FOR JOINING A CABLE TO A PCMCIA CARD

STATEMENT AS TO RIGHTS TO INVENTIONS MADE UNDER FEDERALLY SPONSORED RESEARCH AND DEVELOPMENT

This invention was made under contract with the U.S. Army, contract number DAAD05-96-C-9029.

BACKGROUND OF THE INVENTION

The present invention relates to a connector for attaching a cable to a card used with a personal computer. More specifically, the invention relates to a cable connector for a Personal-Computer-Memory-Card-International-Association ("PCMCIA") card.

Personal computers are sold with certain capabilities and features. Often, it is desirable to upgrade the performance of the computer, by expanding memory for example, or by adding an additional feature, such as a modem or network capability. On desktop computers, features are often added or expanded by removing the computer cover and installing additional components in the computer's interior. On other types of computers, particularly "laptop" or "notebook" computers, it is frequently impractical to disassemble the computer to add capacity or features in the interior of the computer. The difficulty may arise because the computer is crowded with highly integrated components and does not provide the necessary interior volume, and also because the degree of integration of these computers makes them more difficult to disassemble than a desktop model. To provide the capability to expand the capabilities of functions of notebook and laptop computers, many are manufactured with a card slot.

PCMCIA cards, also known as "PC cards", are approximately credit-card-sized cards that conform to a design standard that allows them to be inserted into the card slot and function with the computer without disassembling the computer. The design standard includes, among other features, a standard height, a standard width, and electrical pin configurations. Some PC cards, such as a memory card, interact solely with the computer, that is, they do not have a wire or cable to interface with another electronic device or network. Other cards, such as modem cards, require a cable from the card to connect with a phone line, for example.

Although originally contemplated for use in portable computers, PC cards offer advantages in power consumption, size, and convenience that make them attractive for use with a wide variety of other electronic devices, such as test instrumentation or communication devices, as well as with desktop or other types of computers. Similarly, although originally contemplated as memory modules, PC cards are now available for a wide variety of applications, and some computers provide multiple slots for such PC cards. These slots are typically side-by-side, or stacked on top of each other.

Some electrical connectors on the end of the cable may be simply pushed onto the electrical connector of the PC card. Some connectors positively attach to a PC card with more than the frictional force of the electrical connectors. One type of cable utilizes a spring-loaded clip mechanism that snaps into a mating receptacle on the card, and it is released by manipulating the latching mechanism, i.e. by squeezing the edges of the mechanism, while pulling on the cable to release the cable from the PC card. However, under stress these latches can fail, causing damage to the cable connector, PC card, or both. Latches can be provided that will release under stress; however, many of these types of latches tend to release on one side of the connector before the other side, often damaging the connector pins.

These types of latching mechanisms do not allow the user to attach the cable to the card without latching. This can be time consuming and frustrating in situations where it is impractical to squeeze the latching mechanism to release the latch and remove the cable. In some situations, such as for a temporary connection, it may be desirable to simply push the cable on and pull it off the PC card.

Therefore, it is desirable to provide a cable that is securely attached to a PC card and that would not release from the card in an unpredictable manner, and that would reduce the risk of damaging the electrical connectors on the card and the cable. It is further desirable that the cable be conveniently attached and removed from the PC card by selecting whether or not to engage the latching mechanism.

SUMMARY OF THE INVENTION

According to the present invention a latching mechanism is selectively engagable to provide strong and positive latching to a thin PC card, such as a Type II PCMCIA or Type III PCMCIA PC card, or to allow the cable to be connected and disconnected from the PC card without latching. The present invention provides a technique, including a cable system, for joining a cable to a computer card. In a specific embodiment, a multi-wire cable with a cable end, or backshell, is attached to a PCMCIA card, or PC card. The backshell is molded around an electrical connector and includes thumbscrews captivated by the backshell. The thumbscrews may be extended to engage screw threads incorporated in a mating, but extremely thin, PC card to securely fasten the cable to the PC card, or may be retracted into the backshell, allowing the electrical connector on the cable to be pressed onto a mating electrical connector on the PC card without interference from the threads of the thumbscrews. The cable and thumbscrews are sufficiently small to not interfere with stacked or adjacent PC cards, if present. In another embodiment, an electronic device is connected to the PC card.

Further objects and advantages of our invention will become apparent from a consideration of the drawings and ensuing description.

DESCRIPTION OF THE SPECIFIC EMBODIMENTS

The present invention provides a connector for connecting a cable to a PC card. A novel cable design with retractable thumbscrews allows the cable to be secured to the PC card by screwing the thumbscrews into mating sockets in the PC card, or the cable may be attached to the PC card by pushing the cable connector onto the PC card connector. Securing the cable to the PC card with the thumbscrews provides a connection that is less likely to come apart than prior designs when the connector is used in environments where the cable is likely to experience tensile forces. Specifically, the present connector will secure a cable to a PC card until tensile forces become sufficient to break a component of the connector, typically pulling the threads out of the PC card, while conventional latching mechanisms unlatch at much lower tensile forces, causing damage to the electrical connectors. Such force is typically beyond the force necessary to remove a card from a host device. A surprising and unexpected benefit of the present connector is that it provides a sufficiently strong connection to allow the PC card to be removed from the host by pulling on the cable or backshell without the risk of damage to the cable, connectors, or PC card, unlike conventional connectors. This feature is especially useful if the PC card is in a recessed slot or is otherwise difficult for the operator to access with his fingers.

The capability to push the cable onto the PC card without having to manipulate a latching mechanism provides a quick and convenient technique for attaching the cable to the PC card, and may be used in environments where inadvertently pulling the cable out is unlikely. Thus, the present invention allows a user to select between attaching a cable to a PC card with a positive connection that is superior to conventional attachment mechanisms, and a push-on connection.

The present invention also provides a cable that can be attached to a PC card within the confines of the existing design standards. A cable according to the present invention may be attached to a PC card that is stacked between, or inserted next to, other PC cards. The Type II PCMCIA design specification allows a maximum height of 5.0 mm and width of 54±0.10 mm. Type III PCMCIA cards and other types of PC cards have similar dimensional constraints. Frequently, most of the card backplane area is utilized by the electrical connectors, the connector plug, and alignment features; thus, there is not much available room to implement a latching mechanism. In an embodiment, the maximum width of the connector, including thumbscrews, is 54.1 mm, thus fitting within the standard PCMCIA width dimension and allowing the cable to be used on adjacent cards. The height of the connector is approximately 5.1 mm, which allows cable connectors to be used on stacked cards because the rails that hold the cards in the computer provide the necessary additional clearance.

Figure 1:
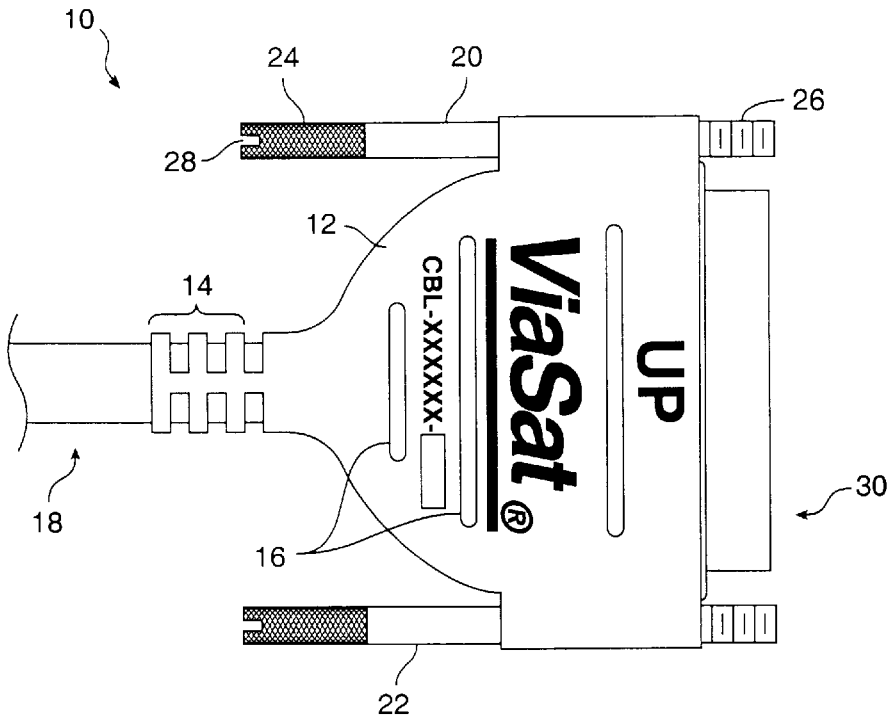
FIG. 1 is a simplified top view of a cable end according to an embodiment of the present invention.

FIG. 1 is a simplified top view of a portion of a cable according to an embodiment of the present invention. A cable assembly 10 includes a molded plastic backshell 12, including a strain relief section 14 and finger-grip ridges 16, is molded around the cable 18 and the thumbscrews 20 and 22. The thumbscrews include a textured section 24, which may be knurled or grooved, for example, for manipulating the thumbscrews, a threaded section 26 for engaging mating threads on a PC card (not shown), and a slot 28, enabling a screwdriver to be used on the thumbscrews when installing or removing the cable from a PC card. The threaded section is threaded with 2-56 UNC-2A type threads, approximately 3 mm long, but could be other types of threads, such as metric threads M 2.5×0.45. The strain relief section prevents kinking of the cable and breaking of the conductors in the cable electrical connector 30. The electrical connector is a type of connector sold by MOLEX, Ltd., of Taiwan, under the part number 89226-0000, but could be other connectors or connectors provided by other suppliers. The finger-grip ridges provide improved gripping of the backshell assembly when inserting or removing the cable electrical connector from the PC card electrical connector, or when removing the PC card from the host instrument by pulling on the connector. In this embodiment, the thumbscrews do not extend beyond the edge of the cable backshell.

The backshell does not have to be molded or made of plastic. For example, the backshell may be made of machined or cast metal parts, or may be assembled from two or more plastic parts that were individually formed. A metal backshell offers the additional feature of providing electromagnetic shielding capability. Electromagnetic shielding is especially important for cables that connect to PC cards that operate at high frequencies (relative to a printer, for example) to reduce electromagnetic emissions that may interfere with other circuits or devices, or for cards that are susceptible to electromagnetic emissions from external sources.

Figure 2:
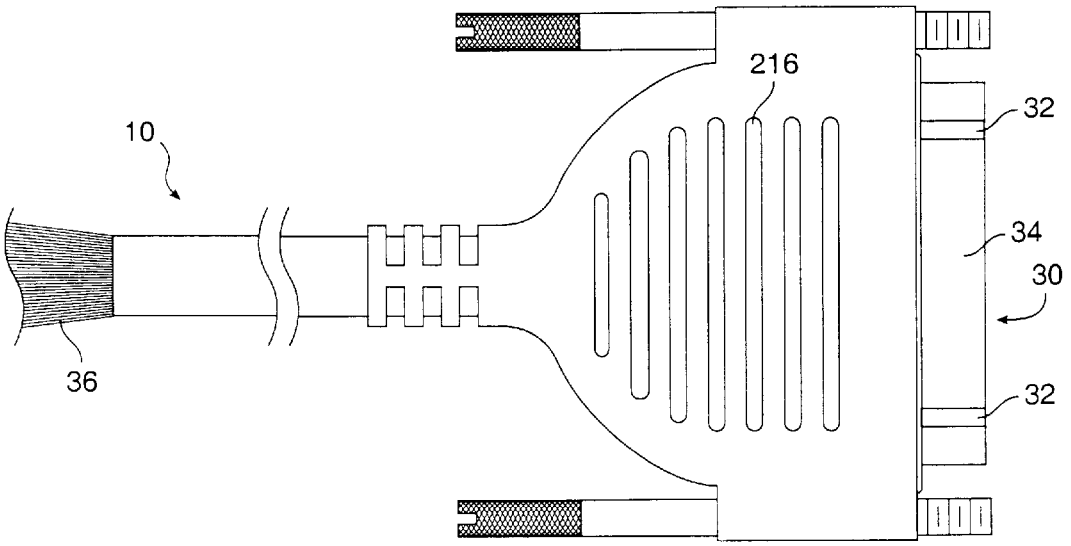
FIG. 2 is a simplified bottom view of a cable end according to an embodiment of the present invention.

FIG. 2 is a simplified bottom view of a portion of a cable according to an embodiment of the present invention. Finger-grip ridges 216 are molded into the bottom surface of the backshell 12 and a keying feature, or features, 32 is molded into the cable connector plug 34. The keying features mate with corresponding features on the PC card (not shown) to prevent the cable from being inserted in the wrong orientation. The cable assembly 10 includes a plurality of wires 36. The number of wires may be equal to, less than, or greater than the number of contacts within the cable electrical connector 30. Furthermore, the cable electrical connector may electrically connect selected contacts together within the connector.

Figure 3:
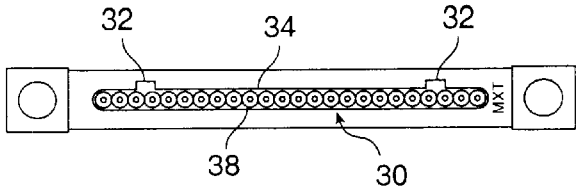
FIG. 3 is a simplified end view of a cable end according to an embodiment of the present invention.

FIG. 3 is a simplified end view of the cable electrical connector 30 and cable connector plug 34. The cable electrical connector includes a plurality of contacts 38. In this instance, the contacts are arranged in a single row of female sockets, although it is understood that other types of contacts and configurations of contacts may be used. Similarly, the cable connector plug is a male plug, but this feature is chosen as an example only, and is not limiting.

Figure 4:
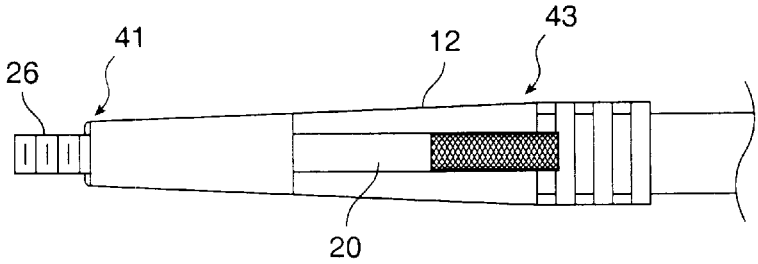
FIG. 4 is a simplified side view of a cable end according to an embodiment of the present invention.

FIG. 4 is a simplified side view of the backshell 12 and a thumbscrew 20, including a threaded portion 26. The thumbscrew is captivated within the molded backshell. The backshell is tapered, having a first thickness 41 approximately equal to the card connector thickness that it will mate to, and a second thickness 43. The second thickness is approximately 5.1 mm. While the second thickness dimension exceeds the Type II PCMCIA standard height, this cable connector still allows stacking of PCMCIA cards because the rails that hold the cards provide enough clearance for the additional cable thickness.

Figure 5:
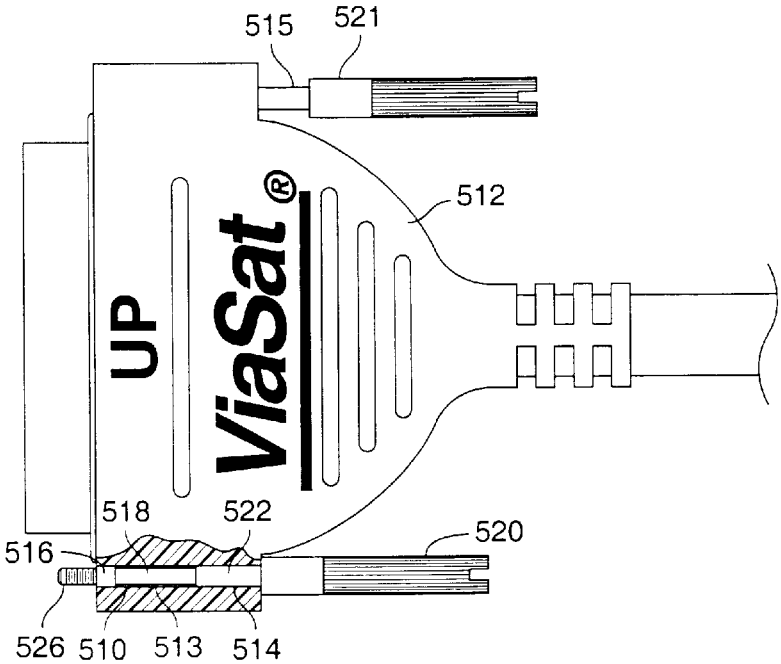
FIG. 5 is a simplified, partial cut-away view of a cable end according to an embodiment of the present invention showing details of a thumbscrew.

FIG. 5 is a partial cut-away view of a portion of the backshell 512 showing an exposed thumbscrew 520. The metal thumbscrew is inserted after the molding process while the backshell is still warm and somewhat soft and compliant. The backshell molding includes a first bearing 510, a stop 513, and a second bearing 514. The thumbscrew 520 has a first journal 516, a shaft 518, and a second journal 522. The first and second journals are supported by the corresponding first and second bearings. The combination of a first and second journal aligns the thumbscrew with respect to the backshell and reduces the risk of cross-threading the thumbscrew when attaching the cable to the PC card. Alignment of the threads is desirable due to the fine nature of the threads, especially if the female threads are formed in brass, plastic, or other relatively soft material. The shaft 518 is a smaller diameter than either journal, and fits between the stop 513. This allows the thumbscrew 520 to move laterally in relation to the backshell without coming out under normal operating forces, and limits the forward travel of the thumbscrew in the backshell by the interaction between the stop 513 and the second journal 514. The length of the shaft allows the threaded portion 526 of the thumbscrew 520 to be withdrawn into the first bearing 510 of the backshell 512. A second thumbscrew 521 is shown with its threaded portion withdrawn into the backshell, which exposes a comparable length of unsupported second journal 515. It is understood that it is not necessary to withdraw the entire threaded portion of the thumbscrew into the backshell in all embodiments, rather only enough need be withdrawn to allow the cable to be pressed onto the PC card.

Figure 6A:
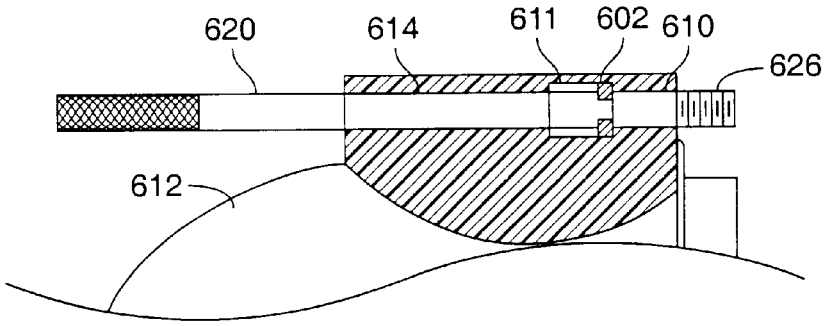
FIGS. 6A–6C are simplified partial cut-away views of portions of various cable end moldings and thumbscrews according to alternative embodiments of the present invention.

FIG. 6A is a partial cut-away view of a portion of a backshell 612 according to another embodiment of the present invention. A first bearing 610 and a second bearing 614 are smaller in diameter than a cylinder 611. The thumbscrew 620 is a constant diameter, and is notched to accept a C-clip 602. The C-clip limits the motion of the thumbscrew within the cylinder, and the length and positions of the cylinder and C-clip are chosen to allow the threaded portion 626 of the thumbscrew to be withdrawn into the backshell. Alternatively, a washer could be press-fit or swaged onto the thumbscrew or a thumbscrew with a shoulder could be used.

Figure 6B:
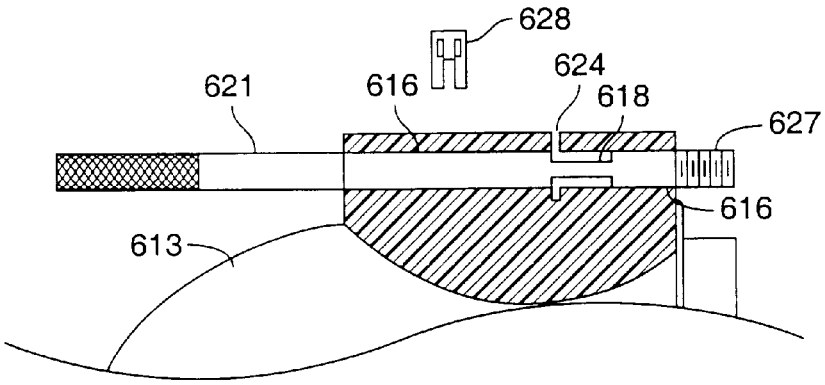

FIG. 6B is a partial cut-away view of a portion of a backshell 613 according to another embodiment of the present invention. The backshell 613 is molded with a constant-diameter bore 616. Alternatively, the backshell could be molded and the bore created later by drilling, for example. A slot 624 is molded or cut into the backshell. The thumbscrew 621 has a narrow section 618. A retaining clip 628 is inserted into the slot 624 to confine the lateral movement of the thumbscrew to the approximate length of the narrow section of the thumbscrew. The retaining clip 628 has been removed from the slot 624 in FIG. 6B for purposes of illustration and clarity. The length and position of the narrow section and slot are chosen to allow retraction of the threaded portion 627 of the thumbscrew 621.

Figure 6C:
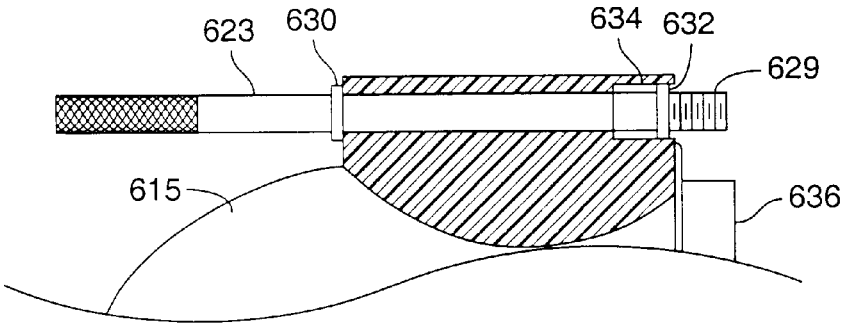

FIG. 6C is a simplified partial cut-away view of a portion of a backshell 615 according to another embodiment of the invention. The thumbscrew 623 includes a forward limit 630 and a retraction limit 632. The retraction limit is withdrawn into a limit cylinder 634 when it is desired to retract the threaded section 629 of the thumbscrew. The retraction limit may also limit the depth to which the threaded section may engage a mating threaded socket (not shown), but it is generally more desirable that the forward limit 630 apply pressure to the backshell 615 to hold the connector 636 against the PC card (not shown) before the threaded section bottoms out in the socket or the retraction limit engages the PC card.

Figure 7:
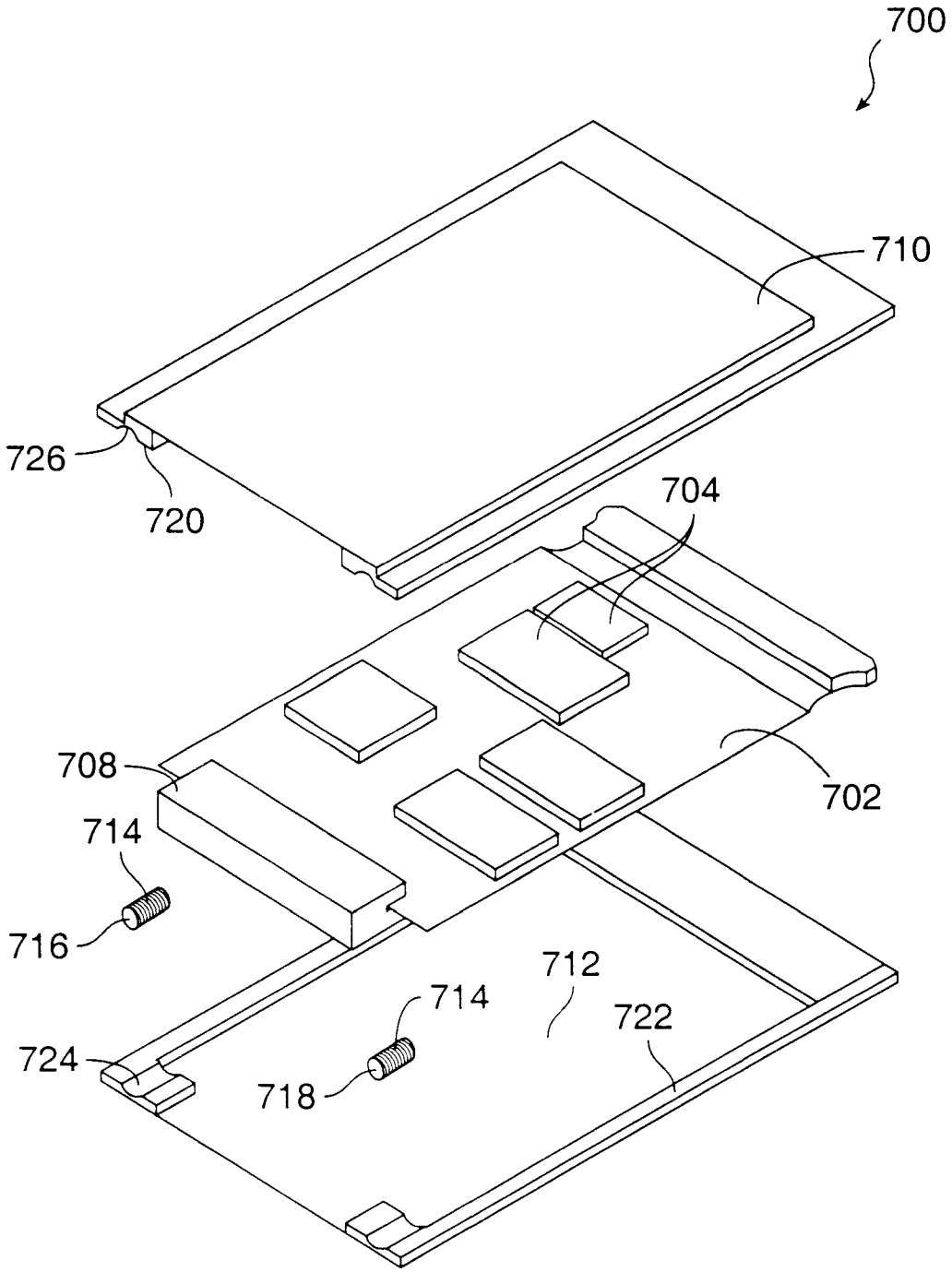
FIG. 7 is a simplified exploded view of a PC card according to an embodiment of the present invention.

FIG. 7 shows a simplified exploded view of a PC card 700 according to an embodiment of the present invention. The PC card includes circuit card assembly 702, which contains various electronic parts 704, a PC card electrical connector 708, a PC card cover top 710, a PC card cover bottom 712, both of which are stainless steel, and threaded inserts, or sockets, 714, which are brass. The threaded inserts include internal threads 716 of type 2-56 UNC-2B and knurling 718 on the outer surface to improve joining the inserts with the PC card cover. The PC card cover top 710 and card cover bottom 712 include plastic bezels 720 and 722, respectively, that allow the top and bottom covers to be sonically welded together. The plastic bezels are formed with detents 724, 726 that accept the threaded inserts 714. After sonically welding the PC card, the threaded inserts are securely attached to the card and resist being pulled out or rotated under normal use. The combination of a card cover top and card cover bottom is commonly known as a "frame kit". It is not necessary to ultrasonically weld the frame kit together, which could be glued together, for example, and other types of frame kits are available that are designed to snap together or to be taped together. The PC card electrical connector 708 is exposed at the back of the card to accept a mating cable electrical connector (not shown).

Figure 8:
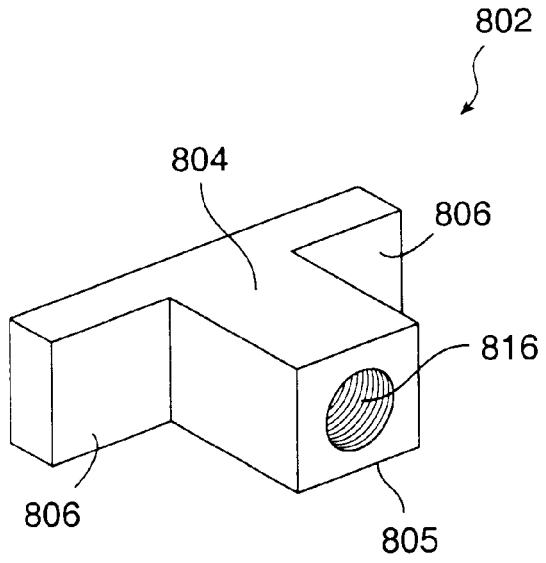
FIG. 8 is a simplified view of a type of threaded insert.

FIG. 8 shows a simplified detailed view of an alternative threaded insert 802. The threaded insert 802 would be used in place of the threaded inserts 714 shown in FIG. 7, with appropriate modifications to the frame kit. Threaded insert 802 has flat surfaces 804, 805 that would co-operate with mating surfaces on the frame kit (not shown) to prevent the threaded insert from rotating within the frame kit when the thumbscrew is inserted or retracted. The complimentary features of a flat frame kit and a flat surface on the insert allow elimination of knurling or similar surface treatments, and provides a positive mechanical torque. Flanges 806 fit in pockets (not shown) in the frame kit and help to keep the threaded insert from being pulled out of the frame kit when the thumbscrews are tightened. The flanges also provide a longer lever arm to the threaded inserts to resist rotation within the frame kit, but are not necessary for this purpose. Those skilled in the art will appreciate that other configurations of inserts will achieve the benefits described above. For example, the insert could have a single flat side, or a single flange. An insert body that is square or rectangular is easier to fit into the frame kit, easier to manipulate during assembly, and allows lower frame kit tooling costs.

A cable is attached to a PC card by pushing the cable electrical connector onto the PC card electrical connector, making sure that any keying features are aligned. In a specific embodiment, the backshell of the cable will be flush with a mating surface of the PC card connector when the cable is joined to the PC card and the threaded portions of the thumbscrews will be at least partially pushed back into the backshell. At this point the user may select whether or not to engage the thumbscrews to the threaded inserts of the PC card to positively attach the cable to the PC card. If the user wishes to engage the latching mechanism, the thumbscrews should be pushed toward the PC card and turned in a clockwise direction until finger-tight. It is not necessary to tighten the thumbscrews with other tools, as the fine pitch of the 2-56 UNC threads provides adequate holding force.

To disconnect the cable from the PC card, the thumbscrews are turned in a counter-clockwise direction until the threads on the thumbscrew separate from the threads on the threaded inserts. A screwdriver may be used in the slot on the end of the thumbscrews if desired. The backshell is then gripped, and the cable connector is pulled away from the PC card.

Figure 9:
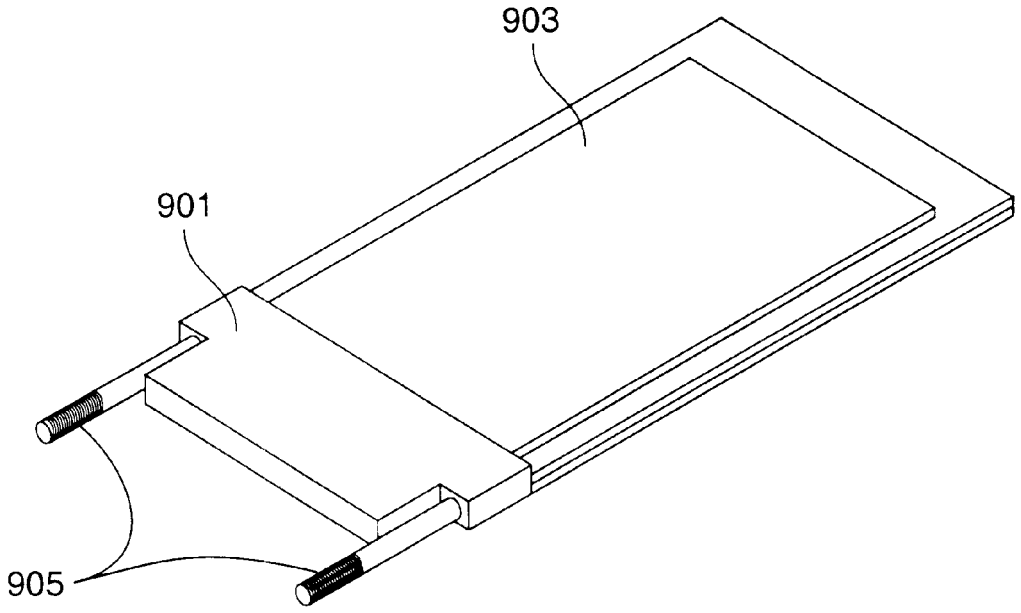
FIG. 9 is a simplified isometric view of a PC card with an electronic device attached to the PC card.

FIG. 9 is a simplified isometric view of another embodiment of the present invention in which an electronic device 901, other than a cable, is attached to a PC card 903. The PC card has threaded sockets (not shown) as described above, and the device includes selectively engageable thumbscrews 905. The device could optionally include another connector (not shown) to connect to a cable or other device. The device 901 could be, for example, an antenna or wireless interface, a stand-alone power supply to power the card independently from the host instrument, a read-only memory (ROM) module, an interface converter, or a multiplexer, among other devices. An interface converter could allow a card to convert from a parallel interface to a serial interface, for example, while attaching different ROMs to a PC card could configure the PC card into different "personalities". A multiplexer might allow a PC card to convert or switch between digital data and audio data inputs.

While the above is a complete description of specific embodiments of the present invention, various modifications, variations, and alternatives may be employed. For example, sockets may be formed in the PC card case by drilling and tapping threads into the case or by molding threads into the case, rather than using threaded inserts. Similarly, the cable connector and PC card connector pair be of a different size, shape, or keying feature, or the thumbscrew could be captured within the backshell in a different manner, such as threads molded inside the mounting hole. The backshell itself could be of a different shape or have different styles of finger grips. Other variations will be apparent to persons of skill in the art. These equivalents and alternatives are intended to be included within the scope of the present invention. Therefore, the scope of this invention should not be limited to the embodiments described, and should instead be defined by the following claims.

What is claimed is:

1. A connector assembly for electrically and mechanically coupling a cable to a readily removably PC card housed within a computer host, the connector assembly comprising:

a threaded socket disposed within the PC card on an edge of the PC card;

a first electrical connector disposed on the edge of the PC card, the first electrical connector defining a mating surface, wherein the first electrical connector has an axis of removal normal to the mating surface;

a second electrical connector incorporated into a backshell of the cable, the second electrical connector mating with the first electrical connector; and a thumbscrew disposed within a bearing in the backshell, the thumbscrew being selectably engageable with the threaded socket, wherein the thumbscrew can be fully retracted into the backshell, the thumbscrew having a journal and a finely threaded portion adapted to provide a sufficiently strong connection to the threaded socket, wherein the journal cooperates with the bearing to align the thumbscrew with the threaded socket;

wherein a tensile force applied to the backshell or cable moves the PC card along the axis of removal and extracts the PC card from the host.

2. The connector assembly of claim 1 wherein the PC card is a Type II PCMCIA card or a Type III PCMCIA card.

3. The connector assembly of claim 1 wherein the threaded socket comprises a metal insert fixed within the PC card.

4. The connector assembly of claim 1 further comprising a second threaded socket disposed within the PC card on the edge of the PC card and a second thumbscrew disposed within the backshell, the second thumbscrew being selectably engageable with the second threaded socket.

5. The connector assembly of claim 1 wherein the threaded portion includes threads of type 2-56 UNC-2A.

6. The connector assembly of claim 1 wherein the threaded portion includes threads of type M 2.5×0.45.

7. The connector assembly of claim 1 wherein the backshell is molded to include a bearing, the bearing supporting a journal on the thumbscrew to align the threaded portion of the thumbscrew with the threaded socket when the second electrical connector is mated to the first electrical connector.

8. The connector assembly of claim 1 wherein the backshell is metal.

9. The connector assembly of claim 1 wherein the backshell has a backshell height and a backshell width substantially equal to a card height and a card width of the PC card.

10. The system of claim 1 further comprising a keying feature on the PC card and a complimentary keying feature on the electrical cable assembly to insure proper alignment between the PC card and the electrical cable assembly.

11. A connector assembly for electrically and mechanically coupling a cable to a readily removable PC card housed in a computer host, the connector assembly comprising:

a readily removable PC card having an upper cover top and a cover bottom;

a pair of threaded metal inserts fixably attached between the upper PC card cover top and the PC card cover bottom on an edge of the PC card, the metal inserts shaped to prevent the inserts from rotating within the PC card cover top, wherein the inserts are adapted to provide a sufficiently strong connection between the PC card and cable;

a first electrical connector disposed on the edge of the PC card, the first electrical connector defining a mating surface, wherein the first electrical connector has an axis of removal normal to the mating surface;

a second electrical connector disposed within a molded backshell of the cable, the second electrical connector capable of electrically coupling with the first electrical connector, the backshell having a maximum thickness of approximately a card thickness of the PC card and a maximum width of approximately a card width of the PC card, and the backshell having a pair of bearings; and a pair of thumbscrews, captivated by the molded backshell, each thumbscrew including a threaded portion and a journal, each of the journals cooperating with each of the pair of bearings to coaxially align each of the pair of thumbscrews with each of the pair of threaded metal inserts when the second electrical connector is coupled to the first electrical connector, and wherein each of the pair of thumbscrews is selectably engageable with each of the pair of threaded metal inserts;

wherein a tensile force applied to the backshell or cable moves the PC card along the axis of removal and extracts the PC card from the host.

12. A connector for connecting an electrical cable to a PC card, the PC card removably disposed in a computer host, the connector comprising:

an electrical connector suitable for making an electrical connection to the PC card;

a backshell containing the electrical connector, the backshell having a bearing, the backshell having a thickness of approximately a card thickness of the PC card, wherein the PC card can be connected to the backshell while stacked between, or inserted next to, a second PC card disposed in a second computer host; and a thumbscrew having a threaded portion and a journal, the backshell captivating the thumbscrew, wherein the threaded portion of the thumbscrew can be at least partially withdrawn into the molded backshell and wherein the bearing works in cooperation with the journal to axially align the thumbscrew within the bearing.

13. The connector of claim 12 wherein the backshell comprises molded plastic.

14. The connector of claim 12 wherein the backshell is metal.

15. The connector of claim 12 wherein the threaded portion includes threads of type 2-56 UNC-2A.

16. The connector of claim 12 wherein the thumbscrew further includes a textured portion.

17. The connector of claim 12 wherein the thumbscrew further includes a slot in a second end of the thumbscrew.

18. The connector of claim 12 further comprising a second thumbscrew.

19. The connector of claim 12 wherein the molded backshell further includes finger grips.

20. The connector of claim 19 wherein the finger grips include ridges.

21. The connector of claim 12 wherein the molded backshell has a width equal to or less than about 54.1 mm.

22. The connector of claim 12 wherein the molded backshell has a thickness equal to or less than about 5.1 mm.

23. The connector of claim 12 wherein the molded backshell has a first thickness region and a second thickness region, the first thickness region being nearer to the electrical connector than the second thickness region and the first thickness region being thinner than the second thickness region.

24. A connector for connecting an electrical cable to a PCMCIA card, the PCMCIA card arranged to be readily removable from a computer host, the connector comprising:

an electrical connector suitable for making an electrical connection to the PC card, the electrical connector having a keying feature which mates with a corresponding feature on the PC card to prevent the electrical connector from being inserted in a wrong orientation;

a plastic backshell molded around the electrical connector, the backshell including a bearing and having a thickness less than or equal to about 5.1 mm and a width less than or equal to about 54.1 mm, such that the PC card can be stacked or inserted next to a second PC card housed in an adjacent second computer host; and a thumbscrew captivated by the backshell, the thumbscrew including a threaded portion of type 2-56 UNC-2A threads on a first end, a textured portion, a slot on a second end, and a journal, wherein the threaded portion can be completely withdrawn into the backshell, and wherein the bearing works in cooperation with the journal to axially align the thumbscrew within the bearing.

25. A PC card capable of being selectably positively attached to an electrical device or cable, the PC card comprising:

an electrical connector disposed on an edge of the PC card, the electrical connector suitable for making an electrical connection with the electrical cable;

a threaded socket disposed on the edge of the PC card and between a PC card case top and a PC card case bottom, the threaded socket being selectively engageable with a mating screw on the electrical cable.

26. The PC card of claim 25 wherein the threaded socket is a metal insert.

27. The PC card of claim 26 wherein the metal insert further includes a knurled outer surface to fixably couple the threaded sockets between the PC card case top and the PC card case bottom.

28. The PC card of claim 25 wherein the PC card case top is sonically welded to the PC card case bottom.

29. The PC card of claim 26 wherein the metal insert further includes a flat surface substantially parallel to a surface of the PC card case top.

30. The PC card of claim 26 wherein the metal insert further includes a flange.

31. The PC card of claim 25 further including a second threaded socket disposed on the edge of the PC card, the second threaded socket being selectively engageable with a second mating screw on the electrical cable.

32. An electronic assembly comprising:

a Type II PCMCIA or Type III PCMCIA PC card;

a pair of threaded sockets disposed on an edge of the PC card;

an electronic device electrically removably coupled to the PC card with an electronic connector; and a pair of thumbscrews disposed within the electronic device, the pair of thumbscrews being selectively engageable with the pair of threaded sockets.

* * * * *